US011795724B1

(12) United States Patent
Reski

(10) Patent No.: US 11,795,724 B1
(45) **Date of Patent: *Oct. 24, 2023**

(54) BASE ASSEMBLY FOR A LATTICE TOWER

(71) Applicant: Great Plains Towers, Inc., West Fargo, ND (US)

(72) Inventor: Kevin Reski, West Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/157,813

(22) Filed: Jan. 21, 2023

Related U.S. Application Data

(63) Continuation of application No. 17/818,882, filed on Aug. 10, 2022, now Pat. No. 11,613,902.

(51) Int. Cl.

| | |
|---|---|
| ***E04H 12/08*** | (2006.01) |
| ***E04H 12/10*** | (2006.01) |
| ***E04H 12/18*** | (2006.01) |
| ***E04H 12/22*** | (2006.01) |
| ***E02D 27/42*** | (2006.01) |

(52) U.S. Cl.
CPC ..... *E04H 12/08* (2013.01); *E02D 27/42* (2013.01); *E04H 12/10* (2013.01); *E04H 12/187* (2013.01); *E04H 12/2261* (2013.01)

(58) Field of Classification Search
CPC ..... E04H 12/08; E04H 12/10; E04H 12/187; E04H 12/2261; E02D 27/42
USPC ... 52/116, 295, 296, 651.01, 651.04, 651.07, 52/652.1, 653.1
See application file for complete search history.

(56) References Cited

U.S. PATENT DOCUMENTS

| | | | | |
|---|---|---|---|---|
| 456,193 | A * | 7/1891 | Detlef | F03D 13/20 169/25 |
| 1,858,925 | A * | 5/1932 | Goodrich | E04H 12/2261 52/295 |
| 1,906,634 | A * | 5/1933 | Leake | E04H 12/2261 52/298 |
| 2,036,047 | A * | 3/1936 | Hill | E02D 27/42 52/166 |
| 2,705,061 | A * | 3/1955 | Getz | E04H 12/16 52/114 |
| 2,740,504 | A * | 4/1956 | Bailey | H01Q 1/1235 52/646 |
| 2,804,950 | A * | 9/1957 | Leslie, Jr. | E04H 12/187 52/646 |
| 2,828,841 | A * | 4/1958 | Weeks | E04H 12/10 403/312 |
| 3,119,471 | A * | 1/1964 | Turner | E04H 12/10 411/389 |
| 4,633,624 | A * | 1/1987 | Targetti | E04C 3/08 52/28 |
| 5,480,265 | A * | 1/1996 | Marshall | E02B 17/027 405/203 |
| 7,726,091 | B2 * | 6/2010 | Frohlich | E04B 1/215 52/707 |
| 2005/0166485 | A1 * | 8/2005 | Sugimoto | B24C 1/10 52/155 |

(Continued)

*Primary Examiner* — Brent W Herring
(74) *Attorney, Agent, or Firm* — Fargo Patent & Business Law; Thomas Kading

(57) ABSTRACT

A tower includes a foot welded to each leg of a lattice section of the tower, each foot having an aperture; an inner gusset welded to each foot and the respective leg, the inner gusset extends toward an inner edge of the respective foot; and an outer gusset welded to each foot, the outer gusset extends toward the aperture of the respective foot.

14 Claims, 5 Drawing Sheets

(56) References Cited

U.S. PATENT DOCUMENTS

| | | | | |
|---|---|---|---|---|
| 2006/0016140 | A1* | 1/2006 | Smith | E02D 27/02 52/295 |
| 2007/0175134 | A1* | 8/2007 | Christenson | E04H 12/345 52/292 |
| 2013/0047544 | A1* | 2/2013 | Dayton | H01Q 1/1242 29/897 |
| 2014/0247542 | A1* | 9/2014 | Fong | H05K 7/00 361/679.01 |
| 2016/0369522 | A1* | 12/2016 | Sanz Pascual | E04B 1/1909 |
| 2021/0246682 | A1* | 8/2021 | Abrams | H01Q 1/246 |

* cited by examiner

FIG. 5
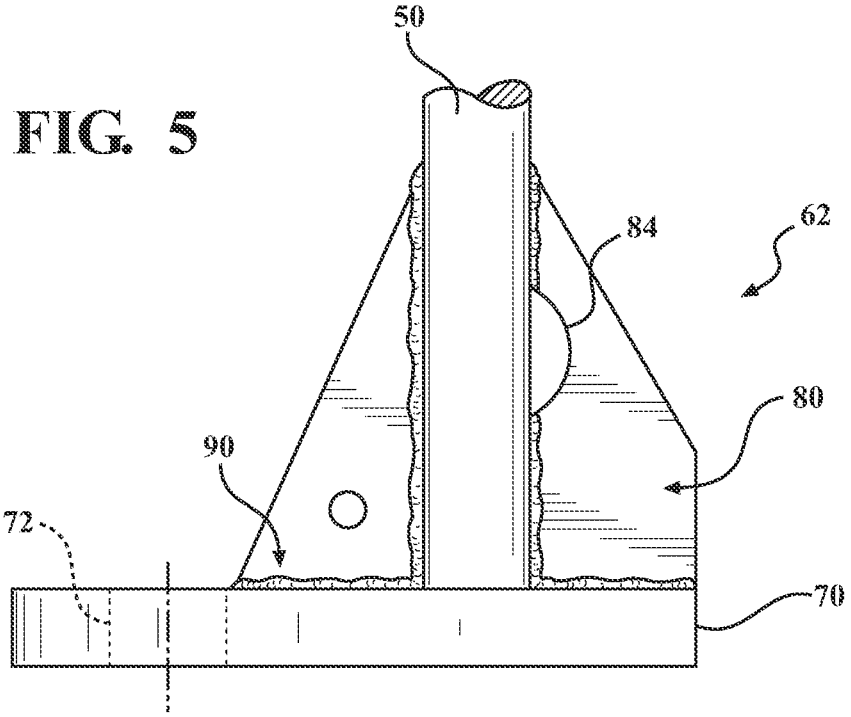
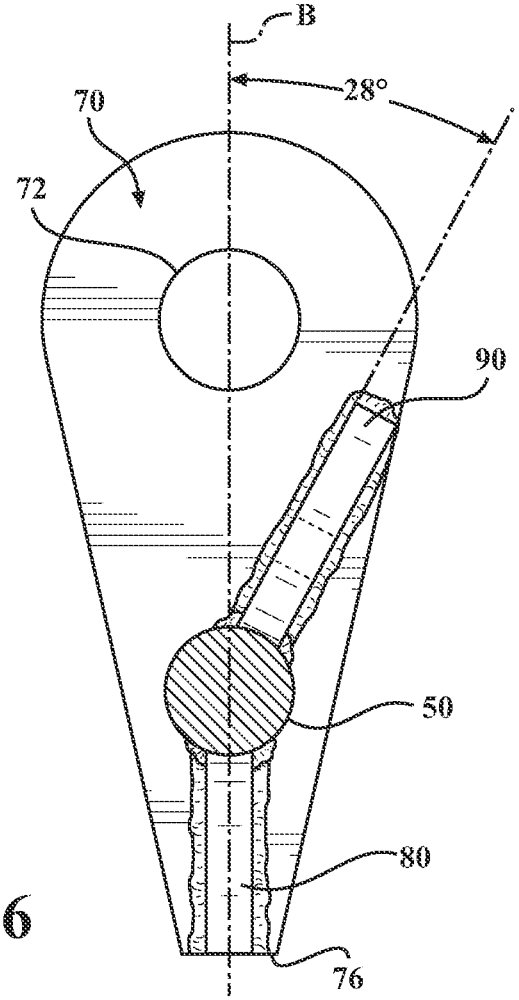
FIG. 6

BASE ASSEMBLY FOR A LATTICE TOWER

The present disclosure is a continuation of U.S. patent application Ser. No. 17/818,882 (now U.S. Pat. No. 11,613,902) filed Aug. 10, 2022.

BACKGROUND

The present disclosure relates to lattice towers, and more particularly to a base assembly therefor to facilitate wind resistance.

Equipment such as antennas, cameras, and the like are often mounted on towers to provide optimal operating positions. When the mounted equipment needs servicing or maintenance, service personnel typically must use an aerial lift, climb the tower, or lower the tower to the ground using a crane. Some towers are pivotable to facilitate access to equipment mounted thereon. High wind conditions are a significant concern for all such towers.

SUMMARY

A tower according to one disclosed non-limiting embodiment of the present disclosure includes a foot welded to each leg of a lattice section of the tower, each foot having an aperture; an inner gusset welded to each foot and the respective leg, the inner gusset extends toward an inner edge of the respective foot; and an outer gusset welded to each foot, the outer gusset extends toward the aperture of the respective foot.

A further embodiment of any of the foregoing embodiments includes that the tower is a hinged lattice tower.

A further embodiment of any of the foregoing embodiments includes that the lattice section is a base lattice section that comprises a first leg, a second leg, and a third leg forming a triangular shaped base lattice section of the tower, the first, second and third leg each constructed of galvanized steel.

A further embodiment of any of the foregoing embodiments includes a tower lattice section hinged to the base lattice section.

A further embodiment of any of the foregoing embodiments includes that the tower lattice section comprises a first, second and third leg each constructed of aluminum.

A further embodiment of any of the foregoing embodiments includes that each outer gusset defines an angle with respect to an axis defined between a center of the aperture and a center of the respective leg.

A further embodiment of any of the foregoing embodiments includes that the outer gusset extends outward toward the aperture.

A further embodiment of any of the foregoing embodiments includes that the outer gusset defines an angle with respect to the axis.

A further embodiment of any of the foregoing embodiments includes that wherein the angle is 28 degrees.

A further embodiment of any of the foregoing embodiments includes that the outer gusset extends for a length greater than the inner gusset with respect to the leg.

A further embodiment of any of the foregoing embodiments includes that a notch in each inner gusset through which extends a first horizontal and a second horizontal.

A further embodiment of any of the foregoing embodiments includes a notch in each inner gusset through which extends a first horizontal and a second horizontal that is welded to the respective leg.

A further embodiment of any of the foregoing embodiments includes that the aperture is operable to receive a bolt that extends from a pier to support the tower.

A further embodiment of any of the foregoing embodiments includes that the inner gusset comprises a notch through which extends a first horizontal and a second horizontal that is welded to the leg, the leg being one of three legs of a triangular shaped tower.

A further embodiment of any of the foregoing embodiments includes that the inner gusset extends to an inner edge of the foot.

A tower according to one disclosed non-limiting embodiment of the present disclosure includes a foot welded to a leg of a lattice section of the tower, each foot having an aperture, the leg constructed of galvanized steel; a foot welded to each leg, each foot having an aperture; an inner gusset welded to each foot and the respective leg, the inner gusset extends toward an inner edge of the respective foot; and an outer gusset welded to each foot, the outer gusset extends outwards toward the aperture of the respective foot, wherein each outer gusset defines an angle with respect to an axis defined between a center of the aperture and a center of the respective leg.

A further embodiment of any of the foregoing embodiments includes that the angle is 28 degrees.

A further embodiment of any of the foregoing embodiments includes that the outer gusset extends for a length greater than the inner gusset with respect to the leg.

A further embodiment of any of the foregoing embodiments includes a tower lattice section hinged to the base lattice section, wherein the tower lattice section is constructed of aluminum.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 5 is a side view of a base flange assembly according to a disclosed non-limiting embodiment.

FIG. 6 is a top view of the base flange assembly of FIG. 5.

DETAILED DESCRIPTION

Figure 1:
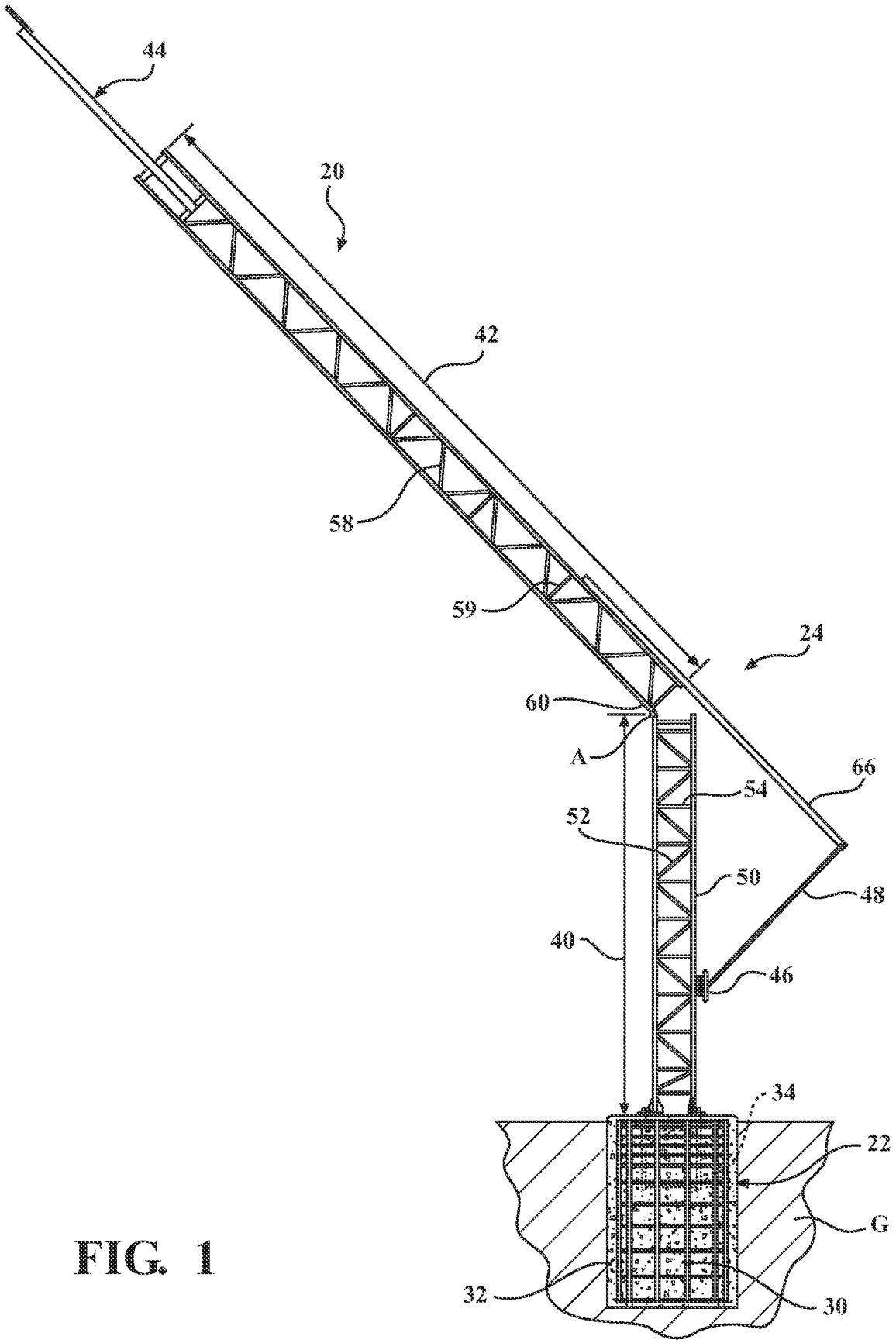
FIG. 1 is a perspective view of a hinged lattice tower structure according to one disclosed non-limiting embodiment.

FIG. 1 schematically illustrates a hinged lattice tower structure 20 that is utilized to erect various instruments. The hinged lattice tower structure 20 generally includes a pier 22 that is located in the ground G to support a hinged lattice tower 24. The pier 22 is typically manufactured primarily of a non-metallic concrete material while the hinged lattice tower 24 is manufactured primarily of metallic materials.

Figure 2:
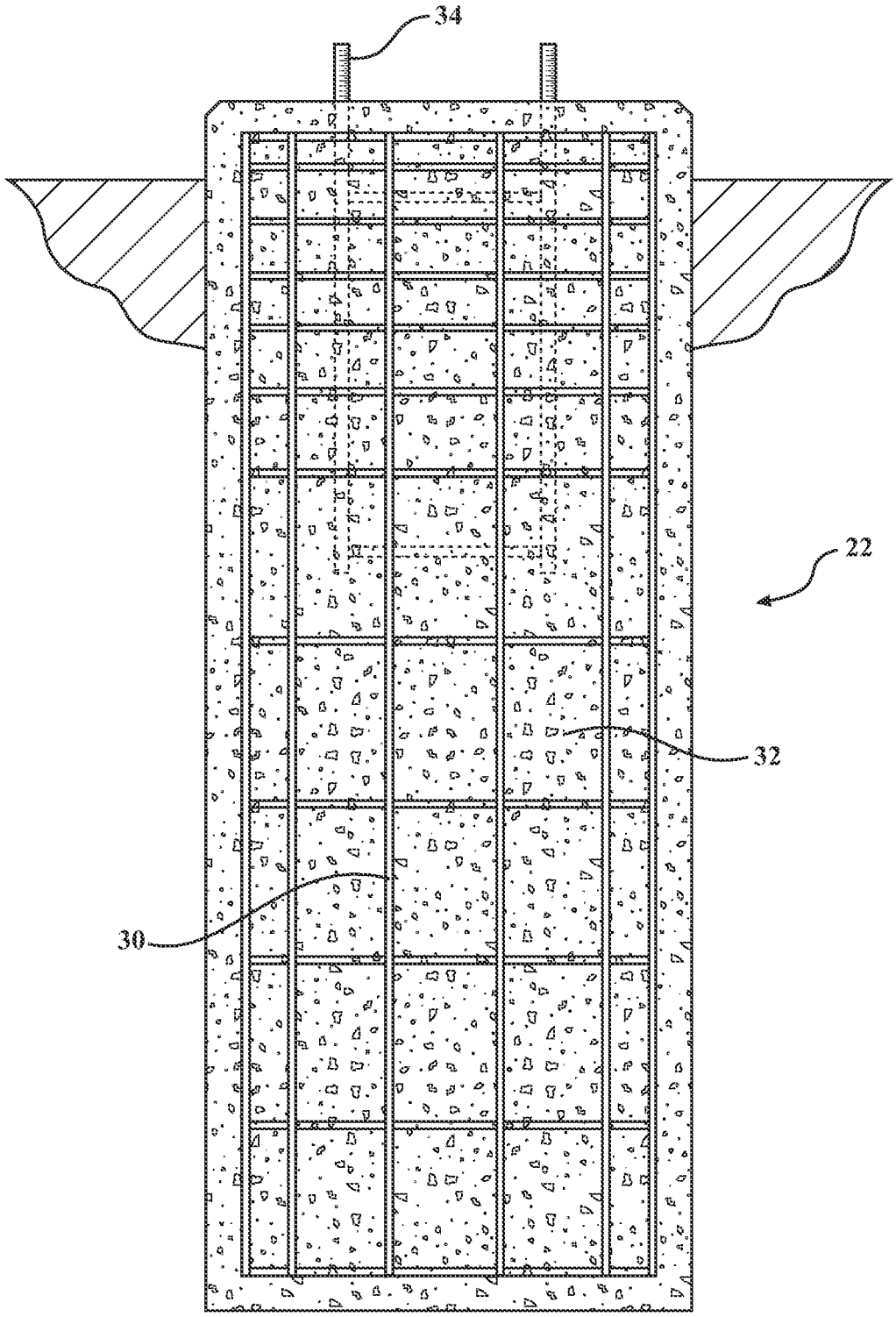
FIG. 2 is a perspective view of a pier for the hinged lattice tower structure according to a disclosed non-limiting embodiment.

In one embodiment, the pier 22 generally includes a rebar support structure 30 that reinforces the concrete material 32 to stabilize and support a cluster of three anchor base bolts 34 (FIG. 2). In one example, the concrete material 32 may be 4000 PSI minimum compressive strength concrete while the cluster of anchor base bolts 34 may include four, foot long, 1 inch diameter bolts.

The hinged lattice tower 24 may be assembled from a multiple of sections such as a base lattice section 40, a tower lattice section 42, and a top mast section 44. It should be appreciated that any number of sections may benefit herefrom. In one embodiment, the base lattice section 40 may be manufactured of an all galvanized steel while the tower lattice section 42 may be manufactured of aluminum. In this embodiment, the base lattice section 40 is 10 feet tall, the tower lattice section 42 is 20 feet tall and the top mast section 44 is 5 feet tall, however, other hinged lattice towers of other heights and configurations will also benefit herefrom.

The base lattice section 40 may be of an all welded construction utilizing 1018 minimum strength 1 inch diameter SR hot dipped galvanized steel legs 50 with 1018 minimum strength 0.5 inch diameter SR hot dipped galvanized steel diagonals 52 and horizontals 54. The legs 50, diagonals 52 and horizontals 54 may be solid steel. In one embodiment, the legs 50 are arranged in a triangular pattern.

The tower lattice section 42 may be of an all welded construction utilizing 6061 T6 1 inch aluminum round legs 56 with 6061 T6⅝" aluminum solid rod diagonals 58 and horizontals 59. The legs 56, diagonals 58 and horizontals 59 may be solid aluminum. In one embodiment, the legs 56 are arranged in a triangular pattern.

A hinge assembly 60 is mounted to the base lattice section 40 and the tower lattice section 42 such that the, tower lattice section 42 is foldable, e.g., tiltable, pivotable, hingeable, etc., about a pivot axis A formed by the hinge assembly 60 between one or more tilted positions whereby the tower lattice section 42 is non-parallel to the base lattice section 40.

A winch 46 is mounted to the base lattice section 40 to deploy and retract a cable 48 that is attached to a raising and lowering arm 66 that extends from the tower lattice section 42. The winch 46 may include any appropriate locking mechanism that may be manipulated by the operator to temporarily prevent or at least reduce the likelihood of the rotation of a crank to maintain the tower in a desired position. One or more ratcheting mechanisms may also be used in relation to the winch. The raising and lowering arm 66 provides a mechanical advantage to the movement of the tower lattice section 42 with respect to the base lattice section 40.

Figure 3:
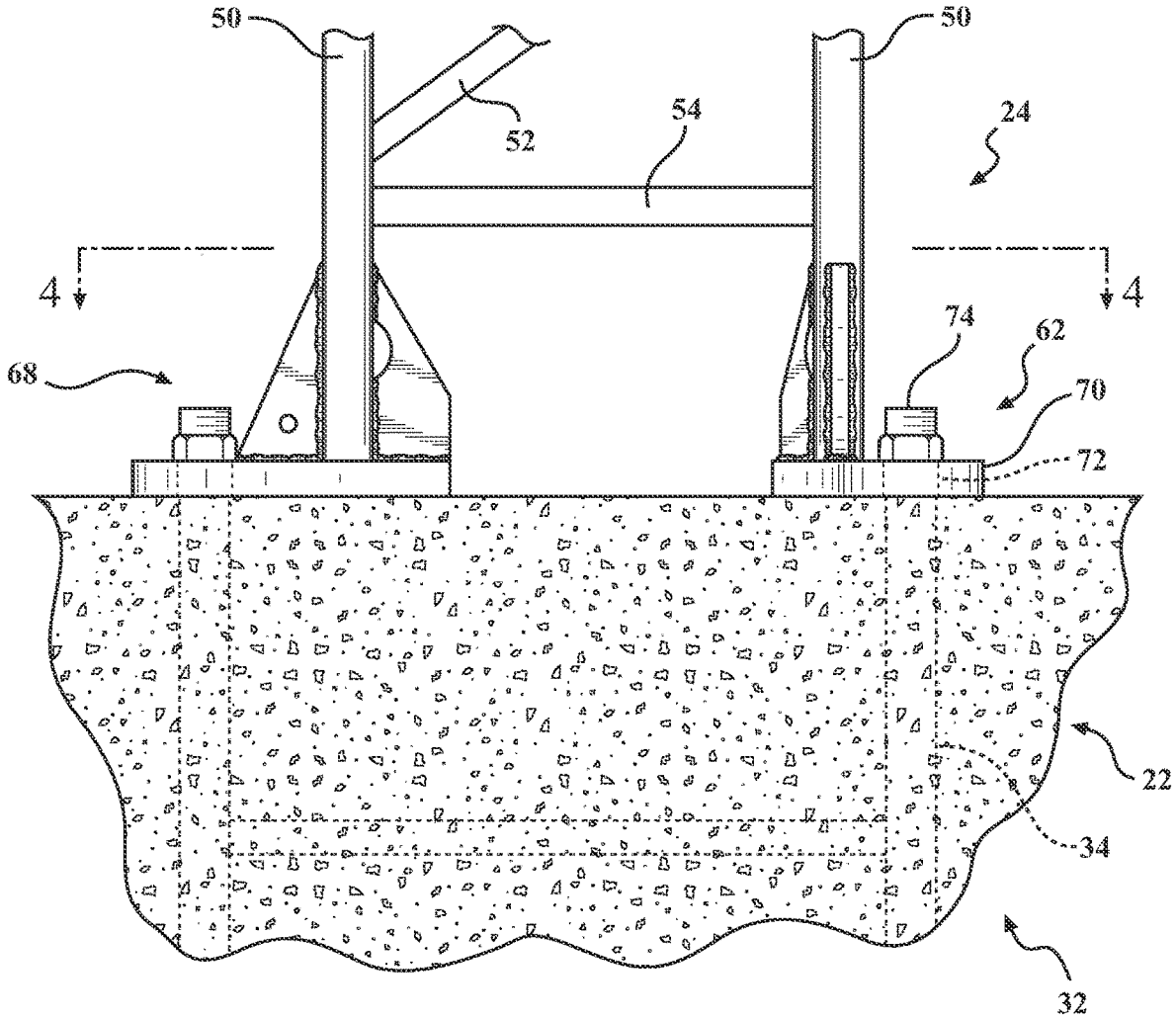
FIG. 3 is an expanded sectional view of a base assembly for the hinged lattice tower structure according to a disclosed non-limiting embodiment.

With reference to FIG. 3, the hinged lattice tower 24 is fastened to the pier 22 via a base assembly 68 that receives the three anchor base bolts 34. The base assembly 68 of the base lattice section 40 includes a base flange assembly 62 on each of the three legs 50. Each base flange assembly 62 includes a foot 70 with an aperture 72 to receive the anchor base bolts 34 which is then retained with a nut 74.

Figure 4:
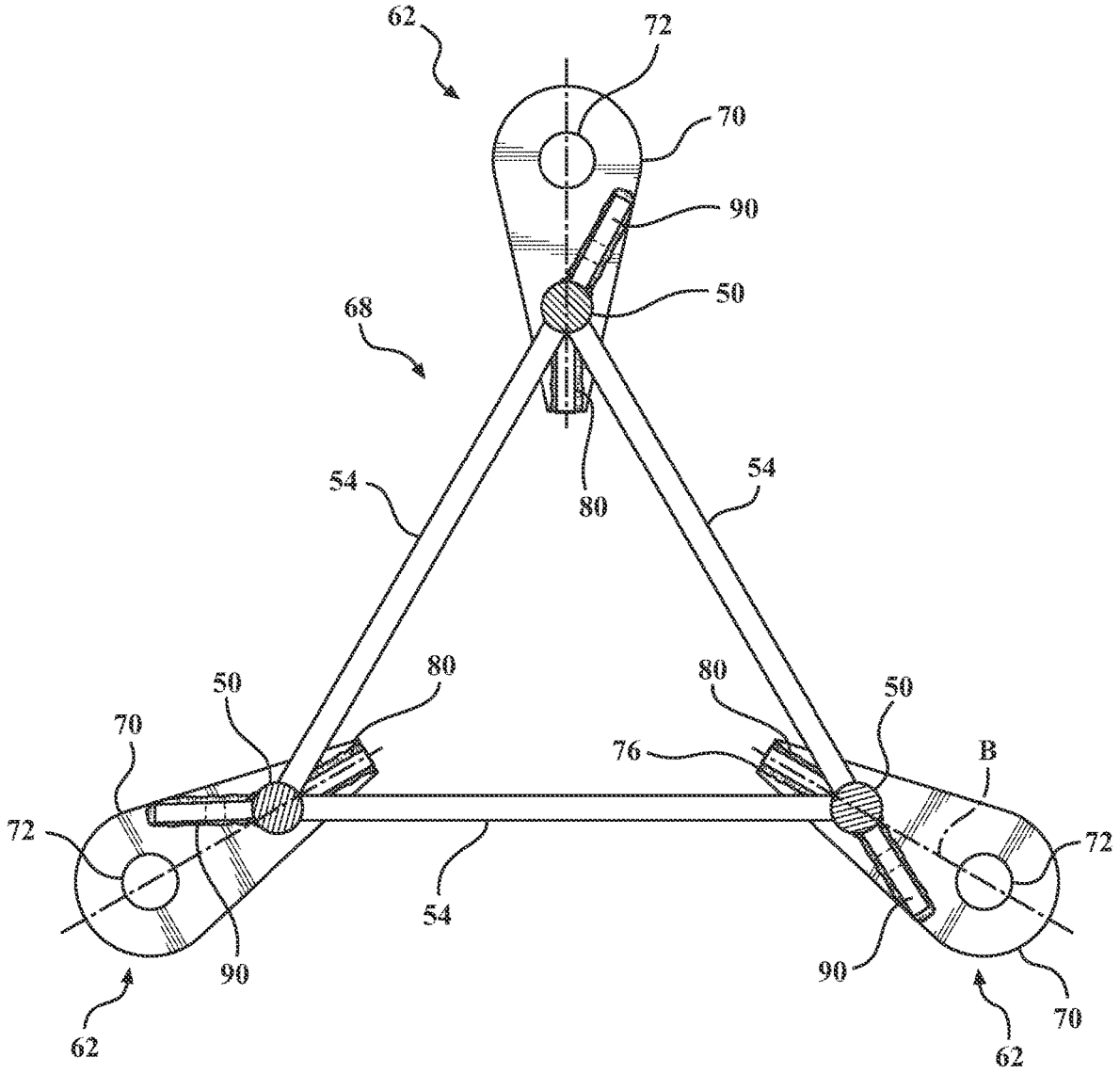
FIG. 4 is a top view of the base assembly.

With reference to FIG. 4, each base flange assembly 62 includes an inner gusset 80 and an outer gusset 90 that are both welded to the foot 70 and the respective leg 50 (FIG. 5). The inner gusset 80 includes a notch 84 that permits welding of the horizontals 54 to the leg 50. The inner gusset 80 is located between the two horizontals 54 that are welded to the leg 50 and extend to an inner edge 76 of the foot 70. In one example, the inner gusset 80 extends 1.625 inches from the leg 50 to the inner edge 76 of the foot 70 along an axis B that is defined between the centers of the aperture 72 and the leg 50.

The outer gusset 90 extends outward toward the aperture 72. The outer gusset 90 in this embodiment defines an angle with respect to axis B of 28 degrees (FIG. 6). In one example, the outer gusset 90 extends 2.0 inches to an outer edge 78 of the foot. The outer gusset 90 essentially extends the horizontals 54 to provide a further interface with the foot 70.

Applicant has determined that the base flange assembly 62 of the disclosed geometry greatly increases the wind resistance of the hinged lattice tower 24 to withstand even hurricane force winds which may be upwards of 180 miles per hour (mph).

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A tower, comprising:

a base lattice section that comprises a first leg, a second leg, and a third leg forming a triangular shaped base lattice section of the tower, the first, second and third leg each constructed of galvanized steel;

a tower lattice section hinged to the base lattice section, wherein the tower lattice section comprises a first, second and third leg each constructed of aluminum;

a foot welded to each leg of the base lattice section, each foot having an aperture;

an inner gusset welded to each foot and the respective leg, the inner gusset extends toward an inner edge of the respective foot; and an outer gusset welded to each foot, the outer gusset extends toward the aperture of the respective foot.

2. The tower as recited in claim 1, wherein the tower is a hinged lattice tower.

3. The tower as recited in claim 1, wherein each outer gusset defines an angle with respect to an axis defined between a center of the aperture and a center of the respective leg.

4. The assembly as recited in claim 1, wherein the outer gusset extends outward toward the aperture.

5. The assembly as recited in claim 4, wherein the outer gusset defines an angle with respect to an axis defined between a center of the aperture and a center of the respective leg.

6. The assembly as recited in claim 5, wherein the angle is 28 degrees.

7. The assembly as recited in claim 6, wherein the outer gusset extends for a length greater than the inner gusset with respect to the leg.

8. The tower as recited in claim 1, further comprising a notch in each inner gusset through which extends a first horizontal and a second horizontal.

9. A tower, comprising:

a foot welded to each leg of a lattice section of the tower, each foot having an aperture;

an inner gusset welded to each foot and the respective leg, the inner gusset extends toward an inner edge of the respective foot;

an outer gusset welded to each foot, the outer gusset extends toward the aperture of the respective foot; and a notch in each inner gusset through which extends a first horizontal and a second horizontal that is welded to the respective leg.

10. A tower, comprising:

a foot welded to each leg of a lattice section of the tower, each foot having an aperture;

an inner gusset welded to each foot and the respective leg, the inner gusset extends toward an inner edge of the respective foot, wherein the inner gusset comprises a notch through which extends a first horizontal and a second horizontal that is welded to the leg, the leg being one of three legs of a triangular shaped tower; and an outer gusset welded to each foot, the outer gusset extends toward the aperture of the respective foot, wherein the aperture is operable to receive a bolt that extends from a pier to support the tower.

11. The assembly as recited in claim 10, wherein the inner gusset extends to an inner edge of the foot.

12. A tower, comprising:

a foot welded to a leg of a lattice section of the tower, each foot having an aperture, the leg constructed of galvanized steel;

a foot welded to each leg, each foot having an aperture;

an inner gusset welded to each foot and the respective leg, the inner gusset extends toward an inner edge of the respective foot; and an outer gusset welded to each foot, the outer gusset extends outwards toward the aperture of the respective foot, wherein each outer gusset defines an angle of 28 degrees with respect to an axis defined between a center of the aperture and a center of the respective leg.

13. The assembly as recited in claim 12, wherein the outer gusset extends for a length greater than the inner gusset with respect to the leg.

14. A tower, comprising:

a base lattice section;

a tower lattice section hinged to the base lattice section, wherein the tower lattice section is constructed of aluminum;

a foot welded to a leg of the base lattice section of the tower, each foot having an aperture, the leg constructed of galvanized steel;

a foot welded to each leg, each foot having an aperture;

an inner gusset welded to each foot and the respective leg, the inner gusset extends toward an inner edge of the respective foot; and an outer gusset welded to each foot, the outer gusset extends outwards toward the aperture of the respective foot, wherein each outer gusset defines an angle with respect to an axis defined between a center of the aperture and a center of the respective leg.

* * * * *